US008820131B2

(12) United States Patent
Fujita

(10) Patent No.: US 8,820,131 B2
(45) Date of Patent: Sep. 2, 2014

(54) SHOT PEENING APPARATUS

(75) Inventor: Jun Fujita, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 228 days.

(21) Appl. No.: 13/512,404

(22) PCT Filed: Nov. 2, 2010

(86) PCT No.: PCT/JP2010/069502
§ 371 (c)(1),
(2), (4) Date: May 29, 2012

(87) PCT Pub. No.: WO2011/074340
PCT Pub. Date: Jun. 23, 2011

(65) Prior Publication Data

US 2012/0227454 A1 Sep. 13, 2012

(30) Foreign Application Priority Data

Dec. 18, 2009 (JP) ..... 2009-288310

(51) Int. Cl.
*C21D 7/06* (2006.01)
*C21D 10/00* (2006.01)

(52) U.S. Cl.
CPC ..... *C21D 10/005* (2013.01)
USPC ..... 72/56

(58) Field of Classification Search
USPC ..... 72/53, 710; 29/90.7; 451/38, 39, 40
See application file for complete search history.

(56) References Cited

U.S. PATENT DOCUMENTS

| | | | | |
|---|---|---|---|---|
| 3,753,318 | A | 8/1973 | Eskijian | |
| 6,095,025 | A * | 8/2000 | Mirabello | 83/177 |
| 6,170,308 | B1 * | 1/2001 | Veronesi et al. | 72/53 |
| 6,278,705 | B1 * | 8/2001 | Chau et al. | 370/352 |
| 6,343,495 | B1 * | 2/2002 | Cheppe et al. | 72/53 |
| 6,505,489 | B2 * | 1/2003 | Berthelet et al. | 72/53 |
| 7,673,486 | B2 * | 3/2010 | Bayer et al. | 72/53 |

FOREIGN PATENT DOCUMENTS

| | | | |
|---|---|---|---|
| GB | 2095144 | A | 9/1982 |
| GB | 2142858 | A | 1/1985 |
| JP | 49-076194 | A | 7/1974 |
| JP | 60-012277 | A | 1/1985 |

(Continued)

OTHER PUBLICATIONS

Translation of Written Opinion (Form PCT/ISA/237) of International Application No. PCT/JP2010/069502, mailed Feb. 1, 2011, (5 pages).

(Continued)

*Primary Examiner* — Teresa M Ekiert
(74) *Attorney, Agent, or Firm* — Westerman, Hattori, Daniels & Adrian, LLP

(57) ABSTRACT

To correspond to a shape of a shot-peening worked portion and to prevent a situation where shot media scatter around the worked portion. To achieve this object, a shot peening apparatus for hitting shot media B against a welded part W and for applying a compressive stress to the welded part includes a kinetic-energy applying unit 26 that applies kinetic energy to the shot media B by an oscillator 26*b*, and a surrounding unit that surrounds both a worked portion U including the welded part W and surroundings of the oscillator 26*b*, and that confines the shot media B within the surrounded region while changing a state to correspond to a shape of the worked portion U.

3 Claims, 3 Drawing Sheets

(56) References Cited

FOREIGN PATENT DOCUMENTS

| | | | |
|---|---|---|---|
| JP | 6-027063 | U | 4/1994 |
| JP | 10-151568 | A | 6/1998 |
| JP | 11-170172 | A | 6/1999 |
| JP | 2000-176840 | A | 6/2000 |
| JP | 2001-210661 | A | 8/2001 |
| JP | 2006-346775 | A | 12/2006 |
| JP | 2009-233784 | A | 10/2009 |

OTHER PUBLICATIONS

Japanese Decision of a Patent Grant dated Dec. 3, 2013, issued in Corresponding Japanese Patent Application No. 2009-288310 with English Translation. (3 pages).
International Search Report of PCT/JP2010/069502, mailing date Feb. 1, 2011; with English translation.
Japanese Written Opinion of PCT/JP2010/069502, mailing date Feb. 1, 2011.

* cited by examiner

SHOT PEENING APPARATUS

FIELD

The present invention relates to a shot peening apparatus.

BACKGROUND

Shot peening is a type of cold working in which shot media that are iron or non-ferrous metal spheres are hit against a metal surface at a high speed, thereby generating a compressive stress on the metal surface and improving fatigue strength against cyclic load. In a pressure vessel in a chemical plant, a reactor vessel or the like, shot peening is performed on, for example, a welded part so as to improve the fatigue strength of a welding joint part.

Conventionally, for example, Patent Literature 1 discloses an ultrasonic shot peening apparatus that performs shot peening on a J-welded part between a lower surface of a reactor vessel cover and a nozzle stub and on a surface adjacent to the J-welded part. This ultrasonic shot peening apparatus includes a disk, ultrasonic peening heads each having an oscillator formed on the disk and inserted into collection holes, and a chamber that is arranged in a state of surrounding an outer circumferential surface of the disk while contacting the outer circumferential surface, that has a cylindrical shape, and an upper edge of which is inclined similarly to a shot-peening worked portion.

CITATION LIST

Patent Literature

Patent Literature 1: Japanese Patent Application Laid-open No. 2006-346775

SUMMARY

Technical Problem

Meanwhile, the compressive stress of the shot media applied onto the worked portion is determined by setting the number of shot media to be hit against the metal surface and setting a working time in response to this number. That is, when the number of shot media decreases, the compressive stress decreases. Particularly in the shot peening performed in a nuclear facility, it is necessary to make the compressive stress constant in one shot peening process because there has been a demand of performing the shot peening only once so as to reduce the time for which workers enter areas where radiation is handled. Therefore, to make the compressive stress in one shot peening process constant, it is necessary to decrease the number of shot media, that is, necessary to prevent the situation where the shot media scatter around the worked portion. Therefore, the apparatus that includes a chamber preventing the situation where the shot media scatter around the worked portion such as the ultrasonic shot peening apparatus described in Patent Literature 1 is employed.

Furthermore, when the shot media scatter around the worked portion in the nuclear facility, the shot media remain in the nuclear facility and possibly influence the function of the nuclear facility. For this reason, it is necessary to recover the entire scattering shot media, which requires lots of labor and which involves the risk of exposure to radiation. Because of this reason also, the apparatus that includes the chamber preventing the situation where the shot media scatter around the worked portion such as the ultrasonic shot peening apparatus described in Patent Literature 1 is employed.

However, the shot-peening worked portion is not always uniform in shape. For example, the overlay thickness of the welded part is designed to be equal to or larger than a predetermined value, and therefore it is not always set constant. Furthermore, the shot-peening worked portion is not always flat. For example, when the shot-peening worked portion is bent like an internal corner, the shape of the chamber becomes complicated. Therefore, under these circumstances, gaps through which the shot media can pass are often formed between the worked portion and the chamber. In this case, it is impossible to prevent the situation where the shot media scatter around the worked portion.

The present invention has been achieved to solve the above problems, and an object of the present invention is to provide a shot peening apparatus that corresponds to a shape of a shot-peening worked portion and that can prevent a situation where shot media scatter around the worked portion.

Solution to Problem

According to an aspect of the present invention, a shot peening apparatus for hitting shot media against a welded part in a nuclear facility and for applying a compressive stress to the welded part, includes: a kinetic-energy applying unit that applies kinetic energy to the shot media by an oscillator; and a surrounding unit that surrounds both a worked portion including the welded part and surroundings of the oscillator, and that confines the shot media within the surrounded region while changing a state to correspond to a shape of the worked portion.

According to this shot peening apparatus, the surrounding unit changes the state to correspond to an overlay thickness of the welded part or the shape of the worked portion including the welded part, whereby the shot media can be confined within the region surrounding both the worked portion including the welded part and the surroundings of the oscillator. Therefore, it is possible to correspond to the shape of the shot-peening worked portion and to prevent a situation where the shot media scatter around the worked portion.

Particularly, when the target worked portion is a nuclear facility, it is possible to prevent a situation where the compressive stress acting on the worked portion decreases and to perform shot peening only once because the number of shot media can be kept constant. Therefore, it is possible to reduce the time for which workers enter areas where radiation is handled. Furthermore, particularly when the target worked portion is the nuclear facility, it is possible to eliminate an operation for recovering the shot media and to prevent the shot media from influencing the function of the nuclear facility as a result of prevention of the situation where the shot media remain in the nuclear facility.

Advantageously, in the shot peening apparatus, the surrounding unit is provided to be movable forward and backward in a direction from the oscillator toward the worked portion and urged toward the worked portion to contact the worked portion, and a forward or backward state of the surrounding unit changes to correspond to the shape of the worked portion.

According to this shot peening apparatus, the state of the surrounding unit can be changed to correspond to the shape of the worked portion and the effects described above can be achieved.

Advantageously, in the shot peening apparatus, the surrounding unit is provided to be movable forward and backward in a direction from the oscillator toward the worked portion and pressed toward the worked portion to contact the worked portion, and a forward or backward state of the surrounding unit changes to correspond to the shape of the worked portion.

According to this shot peening apparatus, the state of the surrounding unit can be changed to correspond to the shape of the worked portion and the effects described above can be achieved.

Advantageously, in the shot peening apparatus, the surrounding unit is configured as a rod-like member which is movable forward and backward in the direction and a tip end thereof faces in a direction from the oscillator toward the worked portion, the rod-like member is configured to surround both the worked portion including the welded part and the surroundings of the oscillator, a plurality of the rod-like members are arranged in such a manner as to prevent the shot media from passing through the surrounded region and spreading out of the surrounded region, and a forward or backward state of the surrounding unit changes to correspond to the shape of the worked portion.

According to this shot peening apparatus, the forward or backward states of the rod-like movable units are changed to correspond to the detailed shape of the worked portion. Therefore, it is possible to correspond to the shape of the shot-peening worked portion and to prevent the situation where the shot media scatter around the worked portion.

Advantageously, in the shot peening apparatus, the surrounding unit surrounds both the worked portion including the welded part and the surroundings of the oscillator with a fluid injected in a direction from the oscillator toward the worked portion, and an injection length of the fluid struck against the worked portion changes to correspond to the shape of the worked portion.

According to this shot peening apparatus, the state of the surrounding unit can be changed to correspond to the shape of the worked portion and the effects described above can be achieved.

Advantageously, in the shot peening apparatus, the fluid is injected in such a manner that the surrounded region that includes both the worked portion including the welded part and the oscillator is made narrower as being closer to the worked portion.

According to this shot peening apparatus, the shot media are forced into the inside of the region in which the shot media are accumulated. Therefore, it is possible to further ensure preventing the situation where the shot media scatter around by the injected fluid.

Advantageously, in the shot peening apparatus, the surrounding unit includes a movable unit which changes a state thereof to correspond to the shape of the worked portion including the welded part, and a fixed wall, and the surrounding unit confines the shot media within the surrounded region while surrounding both the worked portion including the welded part and the oscillator with the movable unit and the fixed wall.

According to this shot peening apparatus, the fixed walls are provided to correspond to regions the shapes of which are defined such as the flat portions of the worked portion, and the surrounding unit can be arranged based on positions of the walls. Therefore, it is possible to easily arrange the surrounding unit with respect to the worked portion in a region appropriate for the worked portion.

According to another aspect of the present invention, a shot peening apparatus for hitting shot media against a welded part and for applying a compressive stress to the shot media, includes: a kinetic-energy applying unit that applies kinetic energy to the shot media by an oscillator; and a surrounding unit that surrounds both a worked portion including the welded part and surroundings of the oscillator, and that confines the shot media within the surrounded region while changing a state to correspond to a shape of the worked portion.

According to this shot peening apparatus, the surrounding unit changes the state to correspond to the overlay thickness of the welded part or the shape of the worked portion including the welded part, whereby the shot media can be confined within the region surrounding both the worked portion including the welded part and the surroundings of the oscillator. Therefore, it is possible to correspond to the shape of the shot-peening worked portion and to prevent a situation where the shot media scatter around the worked portion.

Advantageous Effects of Invention

According to the present invention, it is possible to correspond to the shape of a shot-peening worked portion and to prevent a situation where shot media scatter around the worked portion.

DESCRIPTION OF EMBODIMENTS

Exemplary embodiments of the present invention will be explained below in detail with reference to the accompanying drawings. The present invention is not limited to the embodiments. In addition, constituent elements in the following embodiments include those that can be easily replaced by persons skilled in the art or that are substantially equivalent.

While a shot peening apparatus to be described below is particularly suited to hit shot media against a worked portion including a welded part and to apply a compressive stress to the target worked portion in a nuclear facility, the target worked portion is not limited to that in a nuclear facility.

First Embodiment

Figure 1:
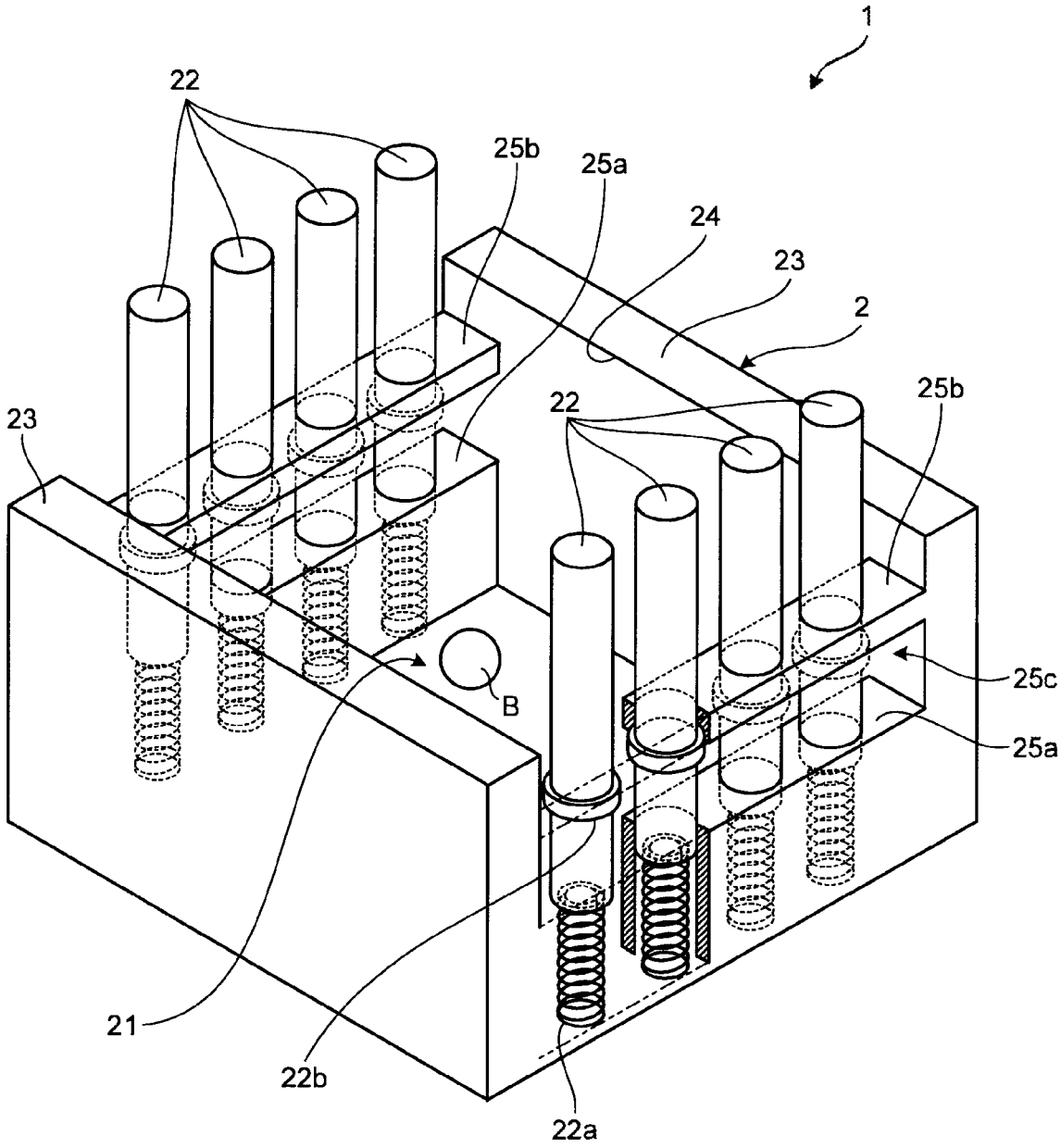
FIG. 1 is a schematic perspective view of a shot peening apparatus according to a first embodiment of the present invention.
Figure 2:
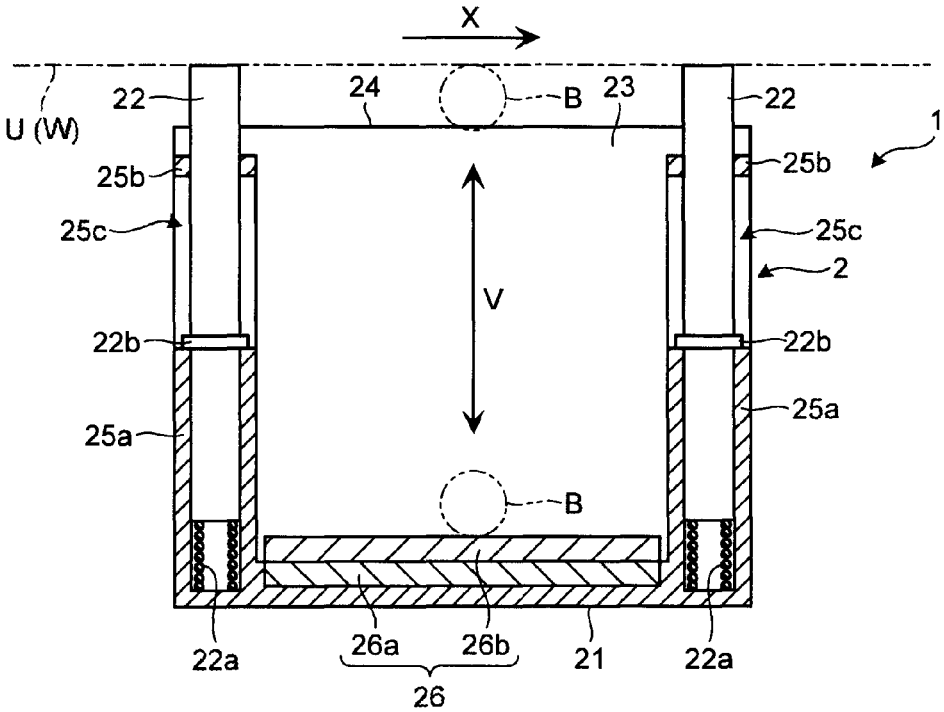
FIG. 2 is a schematic side cross-sectional view of the shot peening apparatus according to the first embodiment of the present invention.
Figure 3:
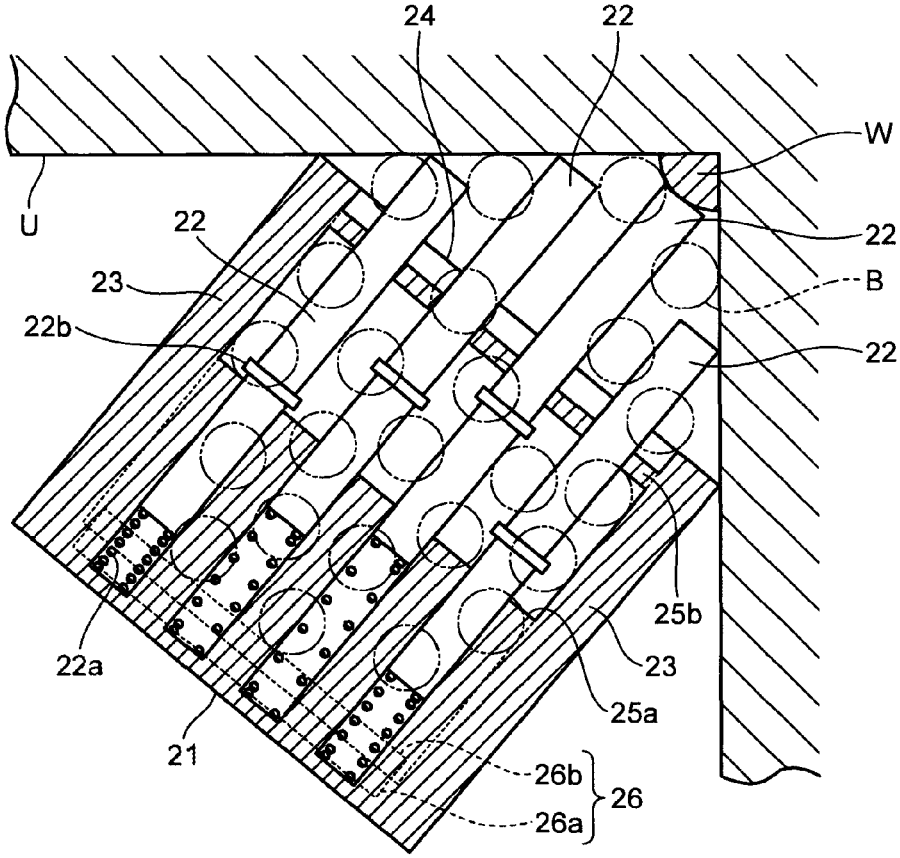
FIG. 3 is a schematic side cross-sectional view of a usage state of the shot peening apparatus according to the first embodiment of the present invention.

FIGS. 1 to 3 depict a shot peening apparatus according to the present embodiment. As shown in FIG. 1, a shot peening apparatus 1 according to the present embodiment includes a surrounding unit (also called "chamber") 2. The surrounding unit 2 surrounds a bottom 21 with movable units 22 and walls 23, and includes an opening 24 that is open to face the bottom 21.

The movable unit 22 is configured as a rod member and built upright on the bottom 21. The movable units 22 are arranged side by side along surroundings of the bottom 21. In the present embodiment, the movable units 22 are arranged side by side along each of two opposite sides of the bottom 21 formed into a rectangular shape. Distances between the rod-like movable units 22 are designed to a size such that shot media B used for shot peening are unable to pass through gaps between the rod-like movable units 22.

Furthermore, each of the movable units 22 is inserted into a hole of a bottom-side guide unit 25*a* and that of an opening-side guide unit 25*b*, and is provided to move forward and backward in an extension direction in which the movable unit 22 is built upright while being guided by the holes of the respective guide units 25*a* and 25*b*. A compression spring 22*a* is arranged in the hole of the bottom-side guide unit 25*a*, and the compression spring 22*a* urges the movable unit 22 in such a manner that the movable unit 22 always moves toward the opening 24. Further, a gap 25*c* is formed between the bottom-side guide unit 25*a* and the opening-side guide unit 25*b*, and a flange 22*b* that prevents the movable unit 22 from falling off is provided around the movable unit 22 to correspond to the gap 25*c*. While the compression spring 22*a* urges the movable unit 22 toward the opening 24, the flange 22*b* abuts on the opening-side guide unit 25*b*, thereby restricting the movable unit 22 from moving toward the opening 24.

The configuration of the rod-like movable unit 22 described above is given only as an example. It suffices that the rod-like movable unit 22 is provided to be movable forward and backward in the extension direction in which the movable unit 22 is built upright, and the configuration is not limited thereto.

The walls 23 are configured as plate members and fixedly built upright on the bottom 21. In the present embodiment, these walls 23 are built upright along two opposite sides, along which the movable units 22 are not provided, of the bottom 21 formed into the rectangular shape.

As shown in FIG. 2, a kinetic-energy applying unit 26 is provided on the bottom 21 of the shot peening apparatus 1. The kinetic-energy applying unit 26 accelerates the shot media B and applies energy necessary for the shot peening to the shot media B. In the present embodiment, the kinetic-energy applying unit 26 is configured to include an oscillating unit 26*a* and a shot-peening oscillator (hereinafter, "oscillator") 26*b*.

The oscillating unit 26*a* vibrates at a predetermined frequency and at a predetermined amplitude so as to accelerate the shot media B, and for example, a piezoelectric element is used as the oscillating unit 26*a*. The oscillator 26*b* is provided on a surface of the bottom 21, is formed into a rectangular shape in proportion to the shape of the bottom 21, and transmits vibration of the oscillating unit 26*a* to the shot media B. The oscillating unit 26*a* is attached either directly or indirectly to the oscillator 26*b*. Although not shown in the drawings, when the oscillating unit 26*a* is attached directly to the oscillator 26*b*, the oscillating unit 26*a* is attached to the oscillator 26*b* via a vibration transmission member, for example.

Although not shown in the drawings, a controller that applies an electric signal at a predetermined frequency to the oscillating unit 26*a* and that vibrates the oscillating unit 26*a* at a frequency having a predetermined cycle is connected to the oscillating unit 26*a*. By allowing the controller to drive the oscillating unit 26*a* of the kinetic-energy applying unit 26 at the frequency having the predetermined cycle (a frequency in an ultrasonic range, for example), the oscillator 26*b* that contacts the shot media B vibrates at the frequency having the predetermined cycle in a direction in parallel to a direction from the oscillator 26*b* to the opening 24 of the surrounding unit 2 (an arrow V direction shown in FIG. 2) and accelerates the shot media B toward the opening 24.

When the shot peening apparatus 1 described above performs shot peening, the opening 24 of the surrounding unit 2 is arranged toward a worked portion U including a welded part W and a plurality of the shot media B are stored in a region surrounded by the bottom 21 (the oscillator 26*b*), the movable units 22, and the walls 23 as shown in FIG. 2. As the shot media B, for example, steel balls or spheres made of non-ferrous metal (non-ferrous metal such as ceramics, for example) are used, and an appropriate type of the shot media B is used to correspond to a material, utilization conditions and the like of the worked portion U. Furthermore, spherical shapes of the shot media B are formed with high accuracy and the shot media B are all equal in diameter.

An end of the side of the opening 24 of each of the walls 23 of the surrounding unit 2 arranged in the direction of the worked portion U is arranged to contact a surface of the worked portion U or to have a gap that the shot media B are unable to pass through. On the other hand, an end of the side of the opening 24 of each of the movable units 22 of the surrounding unit 2 contacts the surface of the worked portion U by an urging force of the compression spring 22*a* as a result of arrangement of the walls 23. The surrounding unit 2 thereby surrounds both the surface of the worked portion U including the welded part W and surroundings of the oscillator 26*b*.

In the shot peening apparatus 1, after arranging the surrounding unit 2 as described above, the kinetic-energy applying unit 26 accelerates the shot media B and applies the energy necessary for the shot peening to the shot media B. The shot media B are thereby struck out toward the opening 24, struck against the surface of the worked portion U, and apply the compression stress to the surface. In this way, the shot peening apparatus 1 performs shot peening on the worked portion U by ultrasonic shot peening. In the present embodiment, the shot peening is not limited to ultrasonic shot peening; however, from the perspective of strict working management, it is preferable to use ultrasonic shot peening.

The shot peening apparatus 1 according to the present embodiment is particularly suited to perform shot peening on the worked portion U having a bent or curved shape. Specifically, as shown in FIG. 3, when the worked portion U including the welded part W is formed as a bent internal corner, the walls 23 are arranged on flat portions of the worked portion U and the movable units 22 are arranged to correspond to bent portions of the worked portion U. The end of the side of the opening 24 of each of the walls 23 is thereby provided to contact the surface of the worked portion U or to have a gap that the shot media B are unable to pass through. On the other hand, the end of the side of the opening 24 of each of the movable units 22 contacts the surface of the worked portion U including the welded part W by the urging force of the compression spring 22*a*, whereby the end of the side of the opening 24 is provided to correspond to the shape of the worked portion U. The surrounding unit 2 thereby surrounds both the surface of the worked portion U including the welded part W and the surroundings of the oscillator 26*b* with respect to the bent worked portion U. Although not shown in the drawings, the surrounding unit 2 can similarly surround both the surface of the worked portion U including the welded part W and the surroundings of the oscillator 26*b* with respect to the curved worked portion U.

Although not shown in the drawings, the shape of the worked portion U is not limited to that of the internal corner described above but is also that of an external corner. In this case, similarly to the case where the shape of the worked portion U is that of the internal corner, the walls 23 are arranged on the flat portions of the worked portion U and the movable units 22 are arranged to correspond to the bent portions or curved portions of the worked portion U. The end of the side of the opening 24 of each of the walls 23 is thereby provided to contact the surface of the worked portion U or to have a gap that the shot media B are unable to pass through. On the other hand, the end of the side of the opening 24 of each of the movable units 22 contacts the surface of the worked portion U including the welded part W by the urging force of the compression spring 22*a*, whereby the end of the side of the opening 24 is provided to correspond to the shape of the worked portion U. The surrounding unit 2 thereby surrounds both the surface of the worked portion U including the welded part W and the surroundings of the oscillator 26*b* with respect to the bent or curved worked portion U.

Although not shown in the drawings, the shape of the worked portion U is not limited to that of the internal corner or the external corner described above. For example, the worked portion U is often a convex or concave without flat portions. In this case, the surrounding unit 2 is configured so that the walls 23 are not provided and that only the movable units 22 are built upright on the bottom 21, and these movable units 22 are arranged to correspond to a convex or concave shape of the worked portion U. The end of the side of the opening 24 of each of the movable units 22 thereby contacts the convex or concave surface of the worked portion U including the welded part W by the urging force of the compression spring 22*a*, whereby the end of the side of the opening 24 is provided to correspond to the shape of the worked portion U. With this configuration, the surrounding unit 2 surrounds both the surface of the worked portion U including the welded part W and the surroundings of the oscillator 26*b* with respect to the worked portion U of various shapes.

Although not shown in the drawings, the shape of the bottom 21 of the surrounding unit 2 and that of the oscillator 26*b* arranged on the surface of the bottom 21 are not limited to the rectangular shape described above. For example, if it is difficult to perform shot peening on the worked portion U with the bottom 21 and the oscillator 26*b* formed into the rectangular shapes, the shape of the bottom 21 and that of the oscillator 26*b* can be set to circular shapes, elliptical shapes, polygonal shapes, indeterminate shapes or the like to correspond to the shape of the worked portion U. In this case, the movable units 22 and the walls 23 are arranged to surround surroundings of the bottom 21 and the oscillators 26*b*. Furthermore, in this case, only the movable units 22 can be arranged without arranging the walls 23.

In this way, the shot peening apparatus 1 according to the first embodiment includes the kinetic-energy applying unit 26 that applies kinetic energy to the shot media B by the oscillator 26*b*, and the surrounding unit 2 that surrounds both the worked portion U including the welded part W and the surroundings of the oscillator 26*b* and that confines the shot media B within the surrounded region while changing a state to correspond to the shape of the worked portion U.

According to the shot peening apparatus 1, the surrounding unit 2 changes the state to correspond to an overlay thickness of the welded part W or the shape of the worked portion U including the welded part W, whereby the shot media B can be confined within the region surrounding both the worked portion U including the welded part W and the surroundings of the oscillator 26*b*. Therefore, it is possible to correspond to the shape of the shot-peening worked portion U and to prevent a situation where the shot media B scatter around the worked portion U.

As a result, particularly when the target worked portion U is a nuclear facility, it is possible to prevent a situation where the compressive stress acting on the worked portion U decreases and to perform shot peening only once because the number of the shot media B can be kept constant. Therefore, it is possible to reduce the time for which workers enter areas where radiation is handled. Furthermore, particularly when the target worked portion U is the nuclear facility, it is possible to eliminate an operation for recovering the shot media B and to prevent the shot media B from influencing the function of the nuclear facility as a result of prevention of the situation where the shot media B remain in the nuclear facility.

In the shot peening apparatus 1 according to the first embodiment, the surrounding unit 2 is provided to be able to move forward and backward in a direction from the oscillator 26*b* toward the worked portion U, and is urged toward the worked portion U by the compression springs 22*a* to contact the worked portion U, and a forward or backward state of the surrounding unit 2 changes to correspond to the shape of the worked portion U.

According to the shot peening apparatus 1, the state of the surrounding unit 2 can be changed to correspond to the shape of the worked portion U and the effects described above can be achieved.

In the shot peening apparatus 1 according to the first embodiment, the surrounding unit 2 is configured as the rod-like movable units 22 a tip end of each of which faces in a direction from the oscillator 26*b* toward the worked portion U and which is provided to be able to move forward and backward in the direction. A plurality of rod-like movable units 22 are arranged side by side so as to surround both the worked portion U including the welded part W and the surroundings of the oscillator 26*b* and to prevent the shot media B from passing through the surrounded region and spreading out of the region. Furthermore, the forward or backward state of each of the rod-like movable units 22 changes to correspond to the shape of the worked portion U.

The shot peening apparatus 1 is configured so that the rod-like movable units 22 are arranged side by side and the forward or backward states of the rod-like movable units 22 are changed to correspond to the shape of the worked portion U. The forward or backward states of the respective rod-like movable units 22 are changed to correspond to the detailed shape of the worked portion U. Therefore, it is possible to correspond to the shape of the shot-peening worked portion U and to prevent the situation where the shot media B scatter around the worked portion U.

In the shot peening apparatus 1 according to the first embodiment, the surrounding unit 2 confines the shot media B within the surrounded region while surrounding both the worked portion U including the welded part W and the oscillators 26*b* with the movable units 22 the states of which change to correspond to the shape of the worked portion U including the welded part W and the fixed walls 23.

According to the shot peening apparatus 1, the fixed walls 23 are provided to correspond to regions the shapes of which are defined such as the flat portions of the worked portion U, and the surrounding unit 2 can be arranged based on positions of the walls 23. Therefore, it is possible to easily arrange the surrounding unit 2 with respect to the worked portion U in a region appropriate for the worked portion U.

In the first embodiment, the movable units 22 are not necessarily configured as a plurality of rod-like members. It suffices that each of the movable units 22 is configured so that the state of the movable unit 22 changes to correspond to the shape of the worked portion U including the welded part W by the urging force of each of the compression springs 22*a*.

In the first embodiment, when shot peening is performed, the shot peening apparatus 1 described above is moved along the welded part W as needed. In this case, it is preferable that the tip end of each of the movable units 22 contacting the worked portion U including the welded part W is formed into an incline shape, a curved shape, or a spherical shape so that a side of the tip end in a moving direction can ride on the welded part W during moving. For example, when the shot peening apparatus 1 is moved in an arrow X direction shown in FIG. 2, at least the side of the tip end of each movable unit 22 in the arrow X direction is formed into the inclined, curved, or spherical shape. With this configuration, it is possible to smoothly change the state of each movable unit 22 (the surrounding unit 2) to correspond to the shape of the worked portion U including the welded part W.

Second Embodiment

Figure 4:
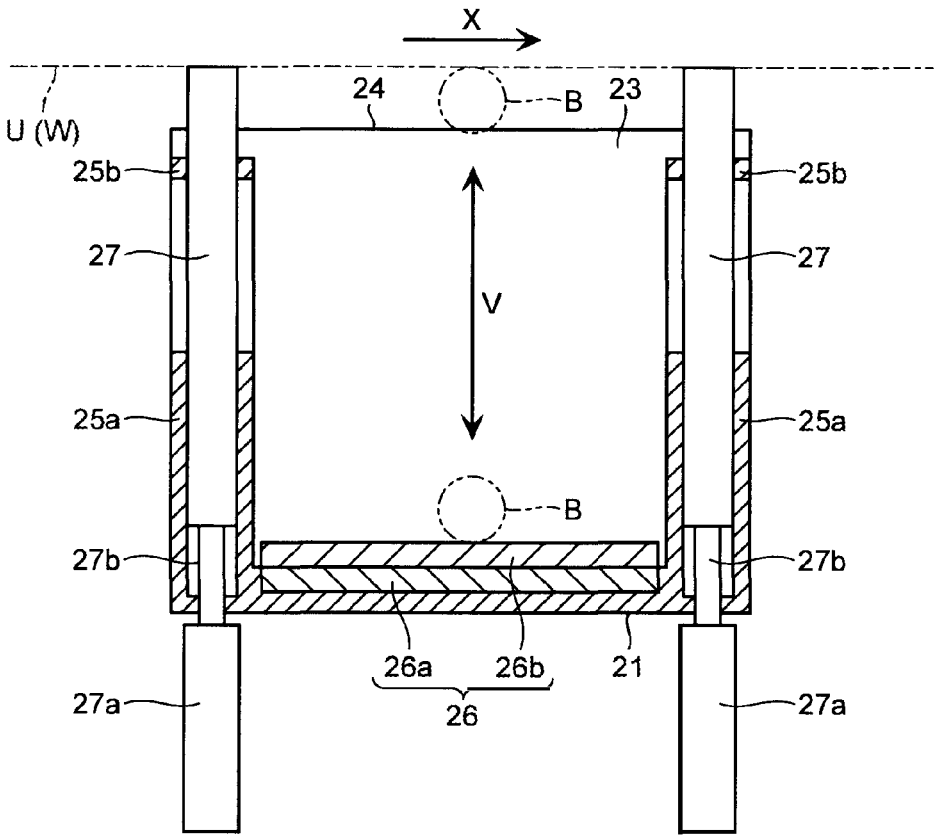
FIG. 4 is a schematic side cross-sectional view of a shot peening apparatus according to a second embodiment of the present invention.

A second embodiment of the present invention is explained with reference to the drawings. FIG. 4 is a schematic sectional side view of a shot peening apparatus according to the second embodiment of the present invention.

Similarly to the shot peening apparatus 1 according to the first embodiment described above, the shot peening apparatus 1 according to the present embodiment includes movable units 27 states of which change to correspond to the shape of the worked portion U including the welded part W, but differs from the shot peening apparatus 1 according to the first embodiment in a configuration of each of the movable units 27. Therefore, in the second embodiment, configurations of the movable units 27 are explained, and other elements equivalent to those described in the first embodiment are denoted by like reference signs and explanations thereof will be omitted.

The movable unit 27 is configured as a rod member and built upright on the bottom 21. The movable units 27 are arranged side by side along surroundings of the bottom 21. In the present embodiment, the movable units 27 are arranged side by side along each of the two opposite sides of the bottom 21 formed into the rectangular shape. Distances between the rod-like movable units 27 are designed to a size such that the shot media B used for shot peening are unable to pass through gaps between the rod-like movable units 27.

Each of the movable units 27 is inserted into the hole of the bottom-side guide unit 25*a* and that of the opening-side guide unit 25*b*, and is provided to move forward and backward in the extension direction in which the movable unit 27 is built upright while being guided by the holes of the respective guide units 25*a* and 25*b*. An extension rod 27*b* of an actuator 27*a* is fixed to an end of the movable unit 27 inserted into the hole of the bottom-side guide unit 25*a*. Examples of the actuator 27*a* include a pneumatic cylinder, a hydraulic cylinder, and a servomotor. That is, the movable unit 27 moves forward and backward in such a manner as to recede toward the bottom 21 while being pressed toward the opening 24 by the actuator 27*a*. The actuator 27*a* can be controlled by the controller (not shown) mentioned above.

When the shot peening apparatus 1 described above performs shot peening, the opening 24 of the surrounding unit 2 is arranged toward the worked portion U including the welded part W and a plurality of the shot media B are stored in the region surrounded by the bottom 21 (the oscillator 26*b*), the movable units 27, and the walls 23 as shown in FIG. 4.

The end of the side of the opening 24 of each of the walls 23 of the surrounding unit 2 arranged in the direction of the worked portion U is arranged to contact the surface of the worked portion U or to have the gap that the shot media B are unable to pass through. On the other hand, an end of the side of the opening 24 of each of the movable units 27 of the surrounding unit 2 contacts the surface of the worked portion U by a pressing force of the actuator 27*a* according to the arrangement of the walls 23. The surrounding unit 2 thereby surrounds both the surface of the worked portion U including the welded part W and surroundings of the oscillator 26*b*.

In the shot peening apparatus 1, after arranging the surrounding unit 2 as described above, the kinetic-energy applying unit 26 accelerates the shot media B and applies the energy necessary for the shot peening to the shot media B. The shot media B are thereby struck out toward the opening 24, struck against the surface of the worked portion U, and apply the compression stress to the surface. In this way, the shot peening apparatus 1 performs shot peening on the worked portion U by ultrasonic shot peening. In the present embodiment, the shot peening is not limited to ultrasonic shot peening; however, from the perspective of strict working management, it is preferable to use ultrasonic shot peening.

The shot peening apparatus 1 according to the present embodiment is particularly suited to perform shot peening on the worked portion U having the bent or curved shape. Specifically, as shown in FIG. 3, when the worked portion U including the welded part W is formed as a bent internal corner, the walls 23 are arranged on the flat portions of the worked portion U and the movable units 27 are arranged to correspond to the bent portions of the worked portion U. The end of the side of the opening 24 of each of the walls 23 is thereby provided to contact the surface of the worked portion U or to have the gap that the shot media B are unable to pass through. On the other hand, the end of the side of the opening 24 of each of the movable units 27 contacts the surface of the worked portion U including the welded part W by the pressing force of the actuator 27*a*, whereby the end of the side of the opening 24 is provided to correspond to the shape of the worked portion U. The surrounding unit 2 thereby surrounds both the surface of the worked portion U including the welded part W and the surroundings of the oscillator 26*b* with respect to the bent worked portion U. Although not shown in the drawings, the surrounding unit 2 can similarly surround both the surface of the worked portion U including the welded part W and the surroundings of the oscillator 26*b* with respect to the curved worked portion U.

Although not shown in the drawings, the shape of the worked portion U is not limited to that of the internal corner described above but is also that of the external corner. In this case, similarly to the case where the shape of the worked portion U is that of the internal corner, the walls 23 are arranged on the flat portions of the worked portion U and the movable units 27 are arranged to correspond to the bent portions or curved portions of the worked portion U. The end of the side of the opening 24 of each of the walls 23 is thereby provided to contact the surface of the worked portion U or to have the gap that the shot media B are unable to pass through. On the other hand, the end of the side of the opening 24 of each of the movable units 27 contacts the surface of the worked portion U including the welded part W by the pressing force of the actuator 27*a*, whereby the end of the side of the opening 24 is provided to correspond to the shape of the worked portion U. The surrounding unit 2 thereby surrounds both the surface of the worked portion U including the welded part W and the surroundings of the oscillator 26*b* with respect to the bent or curved worked portion U.

Although not shown in the drawings, the shape of the worked portion U is not limited to that of the internal corner or the external corner described above. For example, the worked portion U is often the convex or concave without the flat portions. In this case, the surrounding unit 2 is configured so that the walls 23 are not provided and that only the movable units 27 are built upright on the bottom 21, and these movable units 27 are arranged to correspond to the convex or concave shape of the worked portion U. The end of the side of the opening 24 of each of the movable units 27 thereby contacts the convex or concave surface of the worked portion U including the welded part W by the pressing force of the actuator 27*a*, whereby the end of the side of the opening 24 is provided to correspond to the shape of the worked portion U. With this configuration, the surrounding unit 2 surrounds both the surface of the worked portion U including the welded part W and the surroundings of the oscillator 26*b* with respect to the worked portion U of various shapes.

Although not shown in the drawings, the shape of the bottom 21 of the surrounding unit 2 and that of the oscillator 26*b* arranged on the surface of the bottom 21 are not limited to the rectangular shape described above. For example, if it is difficult to perform shot peening on the worked portion U with the bottom 21 and the oscillator 26*b* formed into the rectangular shapes, the shape of the bottom 21 and that of the oscillator 26*b* can be set to circular shapes, elliptical shapes, polygonal shapes, indeterminate shapes or the like to correspond to the shape of the worked portion U. In this case, the movable units 27 and the walls 23 are arranged to surround surroundings of the bottom 21 and the oscillators 26*b*. Furthermore, in this case, only the movable units 27 can be arranged without arranging the walls 23.

In this way, the shot peening apparatus 1 according to the second embodiment includes the kinetic-energy applying unit 26 that applies kinetic energy to the shot media B by the oscillator 26*b*, and the surrounding unit 2 that surrounds both the worked portion U including the welded part W and the surroundings of the oscillator 26*b* and that confines the shot media B within the surrounded region while changing the state to correspond to the shape of the worked portion U.

In the shot peening apparatus 1, the surrounding unit 2 changes the state to correspond to the overlay thickness of the welded part W or the shape of the worked portion U including the welded part W, whereby the shot media B can be confined within the region surrounding both the worked portion U including the welded part W and the surroundings of the oscillator 26*b*. Therefore, it is possible to correspond to the shape of the shot-peening worked portion U and to prevent the situation where the shot media B scatter around the worked portion U.

As a result, particularly when the target worked portion U is the nuclear facility, it is possible to prevent the situation where the compressive stress acting on the worked portion U decreases and to perform shot peening only once because the number of the shot media B can be kept constant. Therefore, it is possible to reduce the time for which workers enter areas where radiation is handled. Furthermore, particularly when the target worked portion U is the nuclear facility, it is possible to eliminate the operation for recovering the shot media B and to prevent the shot media B from influencing the function of the nuclear facility as a result of prevention of the situation where the shot media B remain in the nuclear facility.

In the shot peening apparatus 1 according to the second embodiment, the surrounding unit 2 is provided to be able to move forward and backward in the direction from the oscillator 26*b* toward the worked portion U, and is pressed toward the worked portion U by the actuators 27*a* to contact the worked portion U, and the forward or backward state of the surrounding unit 2 changes to correspond to the shape of the worked portion U.

According to the shot peening apparatus 1, the state of the surrounding unit 2 can be changed to correspond to the shape of the worked portion U and the effects described above can be achieved.

In the shot peening apparatus 1 according to the second embodiment, the surrounding unit 2 is configured as the rod-like movable units 27 a tip end of each of which faces in the direction from the oscillator 26*b* toward the worked portion U and which is provided to be able to move forward and backward in the direction. The rod-like movable units 27 are arranged side by side so as to surround both the worked portion U including the welded part W and the surroundings of the oscillator 26*b* and to prevent the shot media B from passing through the surrounded region and spreading out of the region. Furthermore, the forward or backward states of each of the rod-like movable units 27 changes to correspond to the shape of the worked portion U.

The shot peening apparatus 1 is configured so that the rod-like movable units 27 are arranged side by side and the forward or backward states of the rod-like movable units 27 are changed to correspond to the shape of the worked portion U. The forward or backward states of the respective rod-like movable units 27 are changed to correspond to the detailed shape of the worked portion U. Therefore, it is possible to correspond to the shape of the shot-peening worked portion U and to prevent the situation where the shot media B scatter around the worked portion U.

In the shot peening apparatus 1 according to the second embodiment, the surrounding unit 2 confines the shot media B within the surrounded region while surrounding both the worked portion U including the welded part W and the oscillators 26*b* with the movable units 27 the states of which change to correspond to the shape of the worked portion U including the welded part W and the fixed walls 23.

According to the shot peening apparatus 1, the fixed walls 23 are provided to correspond to the regions the shapes of which are defined such as the flat portions of the worked portion U, and the surrounding unit 2 can be arranged based on the positions of the walls 23. Therefore, it is possible to easily arrange the surrounding unit 2 with respect to the worked portion U in the region appropriate for the worked portion U.

In the second embodiment, the movable units 27 configured as a plurality of rod-like members are not necessarily configured so that the actuator 27*a* applies the pressing force to each of the movable units 27. Although not shown in the drawings, the movable units 27 themselves can be configured as extension rods of a pneumatic cylinder or a hydraulic cylinder, and a pressing force by pneumatic pressure or hydraulic pressure can be collectively applied to the respective movable units 27. Alternatively, the movable units 27 are not necessarily configured as a plurality of rod-like members but it suffices that each of the movable units 27 is configured so that the state of the movable unit 27 changes to correspond to the shape of the worked portion U including the welded part W by the pressing force.

In the second embodiment, when shot peening is performed, the shot peening apparatus 1 described above is moved along the welded part W as needed. In this case, it is preferable that the tip end of each of the movable units 27 contacting the worked portion U including the welded part W is formed into an incline shape, a curved shape, or a spherical shape so that a side of the tip end in a moving direction can ride on the welded part W during moving. For example, when the shot peening apparatus 1 is moved in an arrow X direction shown in FIG. 4, at least the side of the tip end of each movable unit 27 in the arrow X direction is formed into the inclined, curved, or spherical shape. With this configuration, it is possible to smoothly change the state of the movable unit 27 (the surrounding unit 2) to correspond to the shape of the worked portion U including the welded part W.

Third Embodiment

Figure 5:
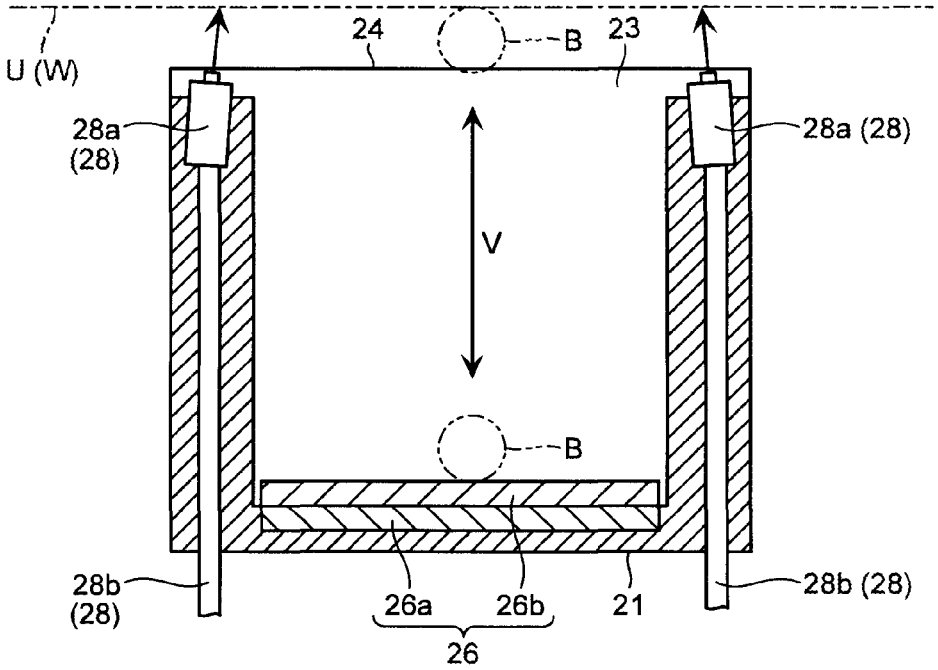
FIG. 5 is a schematic side cross-sectional view of a shot peening apparatus according to a third embodiment of the present invention.

A third embodiment of the present invention is explained with reference to the drawings. FIG. 5 is a schematic sectional side view of a shot peening apparatus according to the third embodiment of the present invention.

Similarly to the shot peening apparatus 1 according to the first embodiment described above, the shot peening apparatus 1 according to the present embodiment includes movable units 28 states of which change to correspond to the shape of the worked portion U including the welded part W, but differs from the shot peening apparatus 1 according to the first embodiment in a configuration of each of the movable units 28. Therefore, in the third embodiment, configurations of the movable units 28 are explained, and other elements equivalent to those described in the first embodiment are denoted by like reference signs and explanations thereof will be omitted.

Each of the movable units 28 includes a nozzle 28*a*, and the movable units 28 are arranged side by side along surroundings of the bottom 21 with injection ports of the nozzles 28*a* directed outward of the opening 24. Each of these movable units 28 includes a supply tube 28*b* that supplies a fluid (liquid or gas) to the nozzle 28*a*. Although not shown in the drawings, the supply tube 28*b* is connected to a reservoir in which the fluid is accumulated and a pump that pneumatically transmits the fluid accumulated in the reservoir. The pump can be controlled by the controller (not shown) mentioned above. That is, by actuating the pump, the fluid accumulated in the reservoir is supplied to the nozzle 28*a* via the supply tube 28*b* and injected from the injection port of the nozzle 28*a*.

When the shot peening apparatus 1 described above performs shot peening, the opening 24 of the surrounding unit 2 is arranged toward the worked portion U including the welded part W and the shot media B are stored in the region surrounded by the bottom 21, the movable units 28, and the walls 23 as shown in FIG. 5.

The end of the side of the opening 24 of each of the walls 23 of the surrounding unit 2 arranged in the direction of the worked portion U is arranged to contact the surface of the worked portion U or to have the gap that the shot media B are unable to pass through. On the other hand, the fluid injected from the nozzle 28*a* is struck against the surface of the worked portion U and each of the movable units 28 of the surrounding unit 2 serves as a wall of the fluid. The surrounding unit 2 thereby surrounds both the surface of the worked portion U including the welded part W and the surroundings of the oscillator 26*b*.

In the shot peening apparatus 1, after arranging the surrounding unit 2 as described above, the kinetic-energy applying unit 26 accelerates the shot media B and applies the energy necessary for the shot peening to the shot media B. The shot media B are thereby struck out toward the opening 24, struck against the surface of the worked portion U, and apply the compression stress to the surface. In this way, the shot peening apparatus 1 performs shot peening on the worked portion U by ultrasonic shot peening. In the present embodiment, the shot peening is not limited to ultrasonic shot peening; however, from the perspective of strict working management, it is preferable to use ultrasonic shot peening.

The shot peening apparatus 1 according to the present embodiment is particularly suited to perform shot peening on the worked portion U having the bent or curved shape. Specifically, as shown in FIG. 3, when the worked portion U including the welded part W is formed as a bent internal corner, the walls 23 are arranged on the flat portions of the worked portion U and the movable units 28 are arranged to correspond to the bent portions of the worked portion U. The end of the side of the opening 24 of each of the walls 23 is thereby provided to contact the surface of the worked portion U or to have the gap that the shot media B are unable to pass through. On the other hand, the fluid injected from the nozzle 28*a* is struck against the surface of the worked portion U including the welded part W and each of the movable units 28 serves as the wall of the fluid. Furthermore, an injection length of the fluid struck against the worked portion U changes to correspond to the shape of the worked portion U. The surrounding unit 2 thereby surrounds both the surface of the worked portion U including the welded part W and the surroundings of the oscillator 26*b* with respect to the bent worked portion U. Although not shown in the drawings, the surrounding unit 2 can similarly surround both the surface of the worked portion U including the welded part W and the surroundings of the oscillator 26*b* with respect to the curved worked portion U.

Although not shown in the drawings, the shape of the worked portion U is not limited to that of the internal corner described above but is also that of the external corner. In this case, similarly to the case where the shape of the worked portion U is that of the internal corner, the walls 23 are arranged on the flat portions of the worked portion U and the movable units 28 are arranged to correspond to the bent portions or curved portions of the worked portion U. The end of the side of the opening 24 of each of the walls 23 is thereby provided to contact the surface of the worked portion U including the welded part W or to have the gap that the shot media B are unable to pass through. On the other hand, the fluid injected from the nozzle 28*a* is struck against the surface of the worked portion U including the welded part W and each of the movable units 28 serves as the wall of the fluid. Furthermore, the injection length of the fluid struck against the worked portion U changes to correspond to the shape of the worked portion U, whereby the wall of the fluid is provided to correspond to the shape of the worked portion U. The surrounding unit 2 thereby surrounds both the surface of the worked portion U including the welded part W and the surroundings of the oscillator 26*b* with respect to the bent or curved worked portion U.

Although not shown in the drawings, the shape of the worked portion U is not limited to that of the internal corner or the external corner described above. For example, the worked portion U is often the convex or concave without flat portions. In this case, the surrounding unit 2 is configured so that the walls 23 are not provided and that only the movable units 28 are built upright along the surroundings of the bottom 21, and these movable units 28 are arranged to correspond to the convex or concave shape of the worked portion U. The fluid injected from the nozzle 28*a* is struck against the surface of the worked portion U including the welded part W and each of the movable units 28 serves as the wall of the fluid. Furthermore, the injection length of the fluid struck against the worked portion U changes to correspond to the shape of the worked portion U, whereby the wall of the fluid is provided to correspond to the shape of the worked portion U. With this configuration, the surrounding unit 2 surrounds both the surface of the worked portion U including the welded part W and the surroundings of the oscillator 26*b* with respect to the worked portion U of various shapes.

Although not shown in the drawings, the shape of the bottom 21 of the surrounding unit 2 and that of the oscillator

26*b* arranged on the surface of the bottom 21 are not limited to the rectangular shape described above. For example, if it is difficult to perform shot peening on the worked portion U with the bottom 21 and the oscillator 26*b* formed into the rectangular shapes, the shape of the bottom 21 and that of the oscillator 26*b* can be set to circular shapes, elliptical shapes, polygonal shapes, indeterminate shapes or the like to correspond to the shape of the worked portion U. In this case, the movable units 28 and the walls 23 are arranged to surround the surroundings of the bottom 21 and the oscillators 26*b*. Furthermore, in this case, only the movable units 28 can be arranged without arranging the walls 23.

In this way, the shot peening apparatus 1 according to the third embodiment includes the kinetic-energy applying unit 26 that applies kinetic energy to the shot media B by the oscillator 26*b*, and the surrounding unit 2 that surrounds both the worked portion U including the welded part W and the surroundings of the oscillator 26*b* and that confines the shot media B within the surrounded region while changing the state to correspond to the shape of the worked portion U.

In the shot peening apparatus 1, the surrounding unit 2 changes the state to correspond to the overlay thickness of the welded part W or the shape of the worked portion U including the welded part W, whereby the shot media B can be confined within the region surrounding both the worked portion U including the welded part W and the surroundings of the oscillators 26*b*. Therefore, it is possible to correspond to the shape of the shot-peening worked portion U and to prevent the situation where the shot media B scatter around the worked portion U.

As a result, particularly when the target worked portion U is the nuclear facility, it is possible to prevent the situation where the compressive stress acting on the worked portion U decreases and to perform shot peening only once because the number of the shot media B can be kept constant. Therefore, it is possible to reduce the time for which workers enter areas where radiation is handled. Furthermore, particularly when the target worked portion U is the nuclear facility, it is possible to eliminate the operation for recovering the shot media B and to prevent the shot media B from influencing the function of the nuclear facility as a result of prevention of the situation where the shot media B remain in the nuclear facility.

In the shot peening apparatus 1 according to the third embodiment, the surrounding unit 2 surrounds both the worked portion U including the welded part W and the surroundings of the oscillator 26*b* by the fluid that is injected from the side of the oscillator 26*b* toward the worked portion U, and the injection length of the fluid struck against the worked portion U changes to correspond to the shape of the worked portion U.

According to the shot peening apparatus 1, the state of the surrounding unit 2 can be changed to correspond to the shape of the worked portion U and the effects described above can be achieved.

In the shot peening apparatus 1 according to the third embodiment, the nozzles 28*a* are provided in a direction of the inside of the opening 24, and the fluid is injected in such a manner that the region surrounding both the worked portion U including the welded part W and the oscillator 26*b* is made narrower as being closer to the worked portion U.

According to the shot peening apparatus 1, the fluid is injected in such a manner that the region surrounding both the worked portion U including the welded part W and the oscillator 26*b* is made narrower as being closer to the worked portion U, whereby the shot media B are forced into the inside of the region. Therefore, it is possible to further ensure preventing the situation where the shot media B scatter around by the injected fluid.

In the shot peening apparatus 1 according to the third embodiment, the surrounding unit 2 confines the shot media B within the surrounded region while surrounding both the worked portion U including the welded part W and the oscillators 26*b* with the movable units 28 the states of which change to correspond to the shape of the worked portion U including the welded part W and the fixed walls 23.

According to the shot peening apparatus 1, the fixed walls 23 are provided to correspond to the regions the shapes of which are defined such as the flat portions of the worked portion U, and the surrounding unit 2 can be arranged based on the positions of the walls 23. Therefore, it is possible to easily arrange the surrounding unit 2 with respect to the worked portion U in the region appropriate for the worked portion U.

INDUSTRIAL APPLICABILITY

As described above, the shot peening apparatus according to the present invention is suitable for corresponding to the shape of a shot-peening worked portion and preventing a situation where shot media scatter around the worked portion.

REFERENCE SIGNS LIST

1 shot peening apparatus
2 surrounding unit
21 bottom
22 movable unit
22*a* compression spring
22*b* flange
23 wall
24 opening
25*a* bottom-side guide unit
25*b* opening-side guide unit
25*c* gap
26 kinetic-energy applying unit
26*a* oscillating unit
26*b* oscillator
27 movable unit
27*a* actuator
27*b* extension rod
28 movable unit
28*a* nozzle
28*b* supply tube
B shot media
U worked portion
W welded part

The invention claimed is:

1. A shot peening apparatus for hitting shot media against a welded part for applying a compressive stress to the welded part, the shot peening apparatus comprising:

a kinetic-energy applying unit that applies kinetic energy to the shot media by an oscillator; and a surrounding unit that surrounds both a worked portion including the welded part and surroundings of the oscillator, and that confines the shot media within the surrounded region while changing a state to correspond to a shape of the worked portion, wherein the surrounding unit is configured as a rod member which is movable forward and backward in a direction from the oscillator toward the worked portion and a tip end of the rod member faces the direction from the oscillator toward the worked portion, the rod member is configured to surround both the worked portion including the welded part and the surroundings of the oscillator, a plurality of the rod members are arranged in such a manner as to prevent the shot media from passing through the surrounded region and spreading out of the surrounded region, and a forward or backward state of the surrounding unit changes to correspond to the shape of the worked portion.

2. The shot peening apparatus according to claim 1, wherein the surrounding unit is urged toward the worked portion to contact the worked portion, and a forward or backward state of the surrounding unit changes to correspond to the shape of the worked portion.

3. The shot peening apparatus according to claim 1, wherein the surrounding unit includes a movable unit which changes a state thereof to correspond to the shape of the worked portion including the welded part, and a fixed wall, and the surrounding unit confines the shot media within the surrounded region while surrounding both the worked portion including the welded part and the oscillator with the movable unit and the fixed wall.

* * * * *